US011773671B2

(12) United States Patent
Tanguy et al.

(10) Patent No.: US 11,773,671 B2
(45) Date of Patent: Oct. 3, 2023

(54) EXPANDABLE LINER HANGER SYSTEM AND METHODOLOGY

(71) Applicant: Saltel Industries, Bruz (FR)

(72) Inventors: Gwenael Tanguy, Bruz (FR); Romain Neveu, Bruz (FR); Samuel Roselier, Bruz (FR)

(73) Assignee: SALTEL INDUSTRIES SAS, Bruz (FR)

( * ) Notice: Subject to any disclaimer, the term of this patent is extended or adjusted under 35 U.S.C. 154(b) by 103 days.

(21) Appl. No.: 17/424,191

(22) PCT Filed: Jan. 23, 2020

(86) PCT No.: PCT/EP2020/051593
§ 371 (c)(1),
(2) Date: Jul. 20, 2021

(87) PCT Pub. No.: WO2020/152253
PCT Pub. Date: Jul. 30, 2020

(65) Prior Publication Data

US 2022/0090457 A1 Mar. 24, 2022

(30) Foreign Application Priority Data

Jan. 23, 2019 (EP) ..... 19305083

(51) Int. Cl.
*E21B 23/04* (2006.01)
*E21B 43/10* (2006.01)

(52) U.S. Cl.
CPC ..... *E21B 23/0412* (2020.05); *E21B 23/0411* (2020.05); *E21B 23/0413* (2020.05); *E21B 43/103* (2013.01)

(58) Field of Classification Search
CPC .. E21B 23/04; E21B 23/0411; E21B 23/0412; E21B 23/0413; E21B 43/103
See application file for complete search history.

(56) References Cited

U.S. PATENT DOCUMENTS 6,959,759 B2 * 11/2005 Doane ..... E21B 33/1208 166/134
8,291,986 B2 10/2012 Gorrara et al.
(Continued)

FOREIGN PATENT DOCUMENTS

GB 2345308 A 7/2000

OTHER PUBLICATIONS

International Search Report and Written Opinion issued in the PCT Application PCT/EP2020/051593, dated Apr. 1, 2020 (13 pages).

*Primary Examiner* — D. Andrews
(74) *Attorney, Agent, or Firm* — Michael Wills, III

(57) ABSTRACT

A technique facilitates setting of a liner hanger in a casing or within other tubular structures via a setting tool. The liner hanger may be constructed with an expandable hanger body between fixed ends. The expandable hanger body is formed from a material, e.g. metal, sufficiently ductile to undergo plastic deformation as it is expanded into engagement with a surrounding casing or other tubing. The expandable hanger body is expanded via fluid delivered under high pressure by the setting tool. The setting tool has a pressure booster to achieve the desired high pressure. The pressure booster may be in the form of a multi-diameter piston constructed to establish the desired high pressure during a single stroke.

18 Claims, 13 Drawing Sheets

(56) References Cited

U.S. PATENT DOCUMENTS

| | | | | |
|---|---|---|---|---|
| 9,702,229 | B2 * | 7/2017 | Zhou | E21B 43/106 |
| 9,739,121 | B2 | 8/2017 | Thomson | |
| 2004/0182583 | A1 | 9/2004 | Doane et al. | |
| 2006/0196656 | A1 | 9/2006 | McGlothen et al. | |
| 2014/0008083 | A1 | 1/2014 | Ring et al. | |
| 2014/0054047 | A1 | 2/2014 | Zhou | |
| 2015/0369021 | A1 * | 12/2015 | Hazelip | E21B 43/105<br>166/383 |

* cited by examiner

EXPANDABLE LINER HANGER SYSTEM AND METHODOLOGY

BACKGROUND

Oil and gas wells may be completed by drilling a borehole in the earth and subsequently lining the borehole with a casing. In many applications, one or more sections of casing and one or more liners are used to complete the well. After the well has been drilled to a first depth, for example, a first section of casing may be lowered into the wellbore and hung from the surface. Cement is then injected into the annulus between the outer surface of the casing and the borehole. After drilling the well to a second designated depth, a liner is run into the well. The liner may then be fixed to the casing by using a liner hanger.

SUMMARY

In general, a system and methodology are provided for utilizing a liner hanger and setting tool in a casing or within other tubular structures. The liner hanger may be constructed with an expandable hanger body between fixed ends, i.e. non-plastically deformable ends. The expandable hanger body is constructed from a material, e.g. metal, sufficiently ductile to undergo plastic deformation as it is expanded into engagement with a surrounding casing or other tubing. The expandable hanger body is expanded via fluid delivered under high pressure by the setting tool. The setting tool has a pressure booster to achieve the desired high pressure. The pressure booster may be in the form of a multi-diameter piston constructed to establish the desired high pressure during a single stroke.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
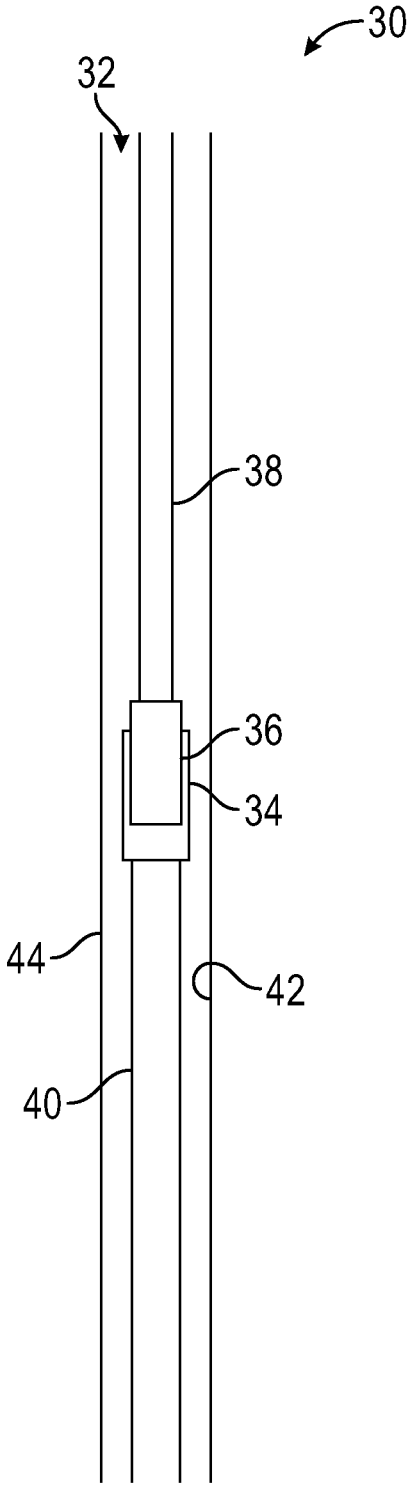
FIG. 1 is a schematic illustration of a liner hanger and setting tool being deployed in a borehole, e.g. a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for utilizing a liner hanger and setting tool in a casing or within other tubular structures. The liner hanger may be constructed with an expandable hanger body between fixed ends, i.e. non-plastically deformable ends. The expandable hanger body is constructed from a material, e.g. metal, sufficiently ductile to undergo plastic deformation as it is expanded into engagement with a surrounding casing or other tubing. The fixed ends are fixed and non-plastically deformable in the sense that they do not undergo appreciable radial plastic deformation. In other words, the fixed ends may undergo some elastic deformation during expansion of the expandable hanger body but they returned to their original configuration upon release of the pressure. In some embodiments, the fixed ends may move, e.g. slide, in an axial direction during expansion of the expandable hanger body.

The expandable hanger body and the fixed ends may be made out of the same or similar materials of different thicknesses or configurations. For example, the fixed ends may have a wall thickness greater than the wall thickness of the expandable hanger body. However, various material structures, configurations, and types may be used to provide the expandable hanger body between the non-plastically deformable ends.

As explained in greater detail below, the expandable hanger body may be expanded via fluid delivered under high pressure by the setting tool. The setting tool has a pressure booster selectively actuated to achieve the desired high pressure. For example, a hydraulic fluid may be trapped in a balanced pressure chamber (balanced with annulus pressure) formed in part by the pressure booster. Pressure activation of the pressure booster causes a substantially increased pressure in the pressure chamber which, in turn, causes actuation fluid to act against the expandable hanger body to radially expand and plastically deform the expandable hanger body.

For example, a lower pressure may be supplied down through the tubing string to act on the pressure booster and to shift the pressure booster linearly relative to a surrounding setting tool body of the setting tool. Because of the design of the pressure booster, this shifting causes a substantially increased pressure on the hydraulic fluid in the pressure chamber. The hydraulic fluid under this substantially intensified pressure is directed to the expandable hanger body to cause the radial expansion and plastic deformation of the expandable hanger body.

The expandable hanger body may be plastically deformed into gripping and sealing engagement with a surrounding casing or other tubular structure. In some embodiments, the expandable hanger body is combined with a plurality of anchoring rings and a plurality of sealing rings which are radially expanded into contact with the surrounding surface, e.g. surrounding casing surface, to anchor and seal the expandable liner hanger with respect to the surrounding surface.

To achieve the intensified or increased pressure (e.g. 10,000-25,000 psi) for expanding the expandable hanger body, the pressure booster may be in the form of a solid walled, multi-diameter piston disposed in sliding and sealing engagement with the surrounding setting tool body. The seals formed at the different diameters are arranged to establish the desired higher pressure relative to the pressure applied to shift the pressure booster during pressure activation of the pressure booster. The boosting or intensifying of pressure via the pressure booster may be achieved via a single stroke of the pressure booster relative to the setting tool body. It should be noted the end travel of the pressure booster stroke may be used to release the setting tool from the expandable liner hanger after setting of the expandable liner hanger.

Referring generally to FIG. 1, an example of a well system 30 is illustrated as deployed in a borehole 32, e.g. a wellbore. The well system 30 comprises an expandable liner hanger 34 coupled with a setting tool 36. The setting tool 36 is connected with a tubing string 38, e.g. a drill pipe. The expandable liner hanger 34 may be connected to a liner 40 which is suspended down into the borehole 32 below the expandable liner hanger 34. The expandable liner hanger 34 and setting tool 36 are deployed to a desired location in borehole 32 and then setting tool 36 is actuated to expand the liner hanger 34 into anchored and sealing engagement with a surrounding wall surface 42. By way of example, the wall surface 42 may be the interior surface of a casing 44 or other well tubing.

Figure 2:
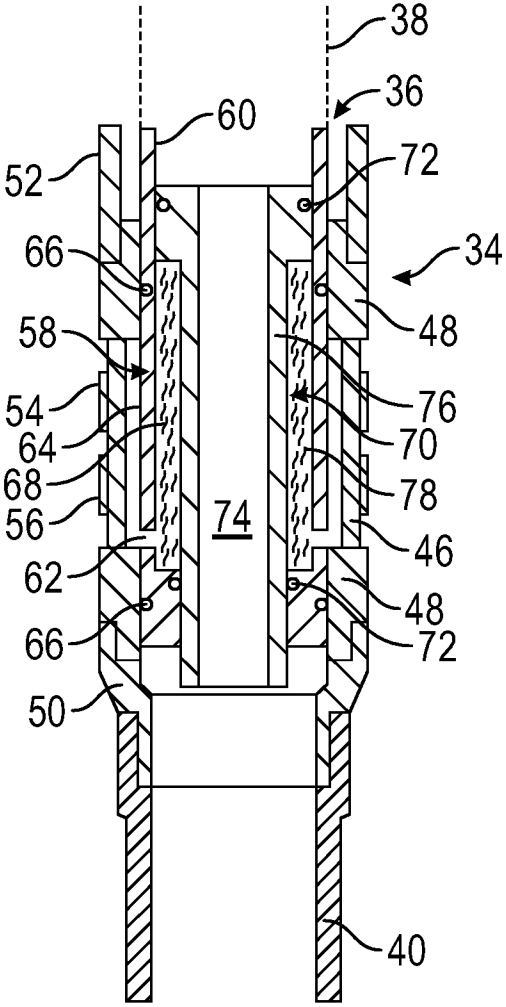
FIG. 2 is a cross-sectional illustration of an example of an expandable liner hanger combined with a setting tool, according to an embodiment of the disclosure.

Referring generally to FIG. 2, a schematic illustration of an example of expandable liner hanger 34 combined with setting tool 36 is illustrated. In this embodiment, the expandable liner hanger 34 comprises an expandable hanger body 46, e.g. an expandable metal hanger body, connected between fixed ends 48. In some embodiments, the expandable metal hanger body 46 and fixed ends 48 are constructed from the same metal material and are part of a single piece.

The expandable liner hanger 34 may be coupled with liner 40 via an adapter sub 50 or other suitable structure. In some embodiments, a receptacle 52 or other suitable tubular structure may be connected to an upper end of the expandable liner hanger 34.

In the illustrated example, the expandable liner hanger 34 also comprises an anchor structure 54 mounted to expandable hanger body 46. By way of example, the anchor structure 54 may comprise an anchor ring or a plurality of anchor rings disposed about the outer circumference of the expandable hanger body 46. Additionally, the expandable liner hanger 34 may comprise a sealing structure 56 mounted to expandable hanger body 46. By way of example, the sealing structure 56 may comprise a sealing ring or a plurality of sealing rings disposed about the outer circumference of the expandable hanger body 46.

In the embodiment illustrated, the setting tool 36 is releasably coupled with the expandable liner hanger 34. Additionally, the setting tool 36 comprises a setting tool body 58 which is configured to form an interior 60, e.g. a multitiered cylindrical interior, extending longitudinally therethrough and having a plurality of different diameters. The setting tool body 38 also comprises a port 62, e.g. a plurality of ports, extending from the interior 60 to a sealed exterior region 64 located between the setting tool body 58 and the expandable hanger body 46. The sealed exterior region 64 is formed by a plurality of seals 66 located between the setting tool body 58 and the liner hanger 34.

In this specific example, the port 62 extends from a pressure chamber 68 located in the interior 60 between setting tool body 58 and a pressure booster 70. The pressure chamber 68 is formed between setting tool body 58 and pressure booster 70 via a plurality of seals 72 which have different diameters. As illustrated, the pressure booster 70 is thus slidably and sealably mounted along the interior 60 of setting tool body 58. The pressure booster 70 also has a plurality of differing booster diameters which cooperate with the corresponding different diameters of interior 60 via seals 72.

The pressure booster 70 comprises a longitudinal pressure booster passage 74 extending therethrough and defined by a solid wall structure 76. The solid wall structure 76 has a solid wall along its length without having lateral ports or openings between the internal booster passage 74 and the exterior of the pressure booster 70.

Figure 3:
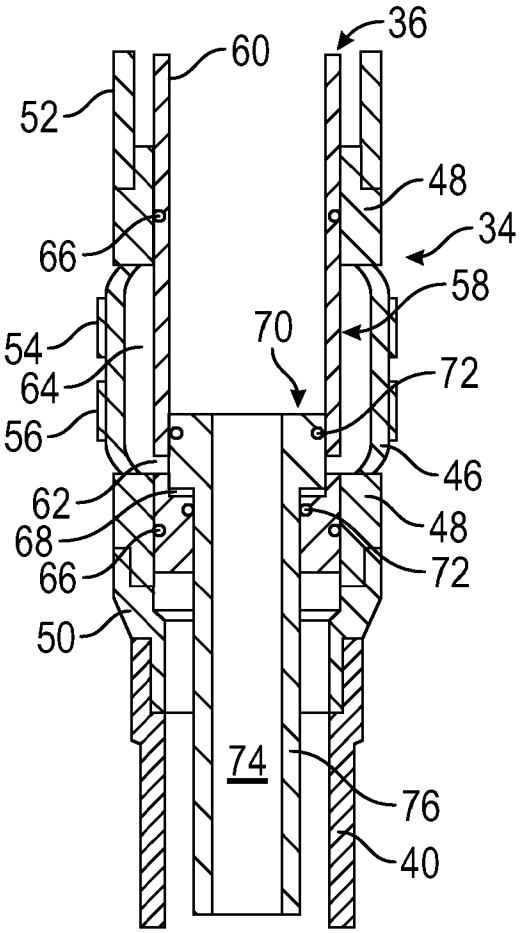
FIG. 3 is an illustration similar to that of FIG. 2 but in a different operational position, according to an embodiment of the disclosure.

The multi-diameter pressure booster 70 and the corresponding seals 72 of differing diameters are arranged to create an increased pressure, e.g. a boosted or intensified pressure, in pressure chamber 68 relative to an actuation pressure applied down through tubing string 38. As explained in greater detail below, the pressure booster 70 is thus able to use a lower actuation pressure applied through tubing string 38 to cause a linear movement of the pressure booster 70 relative to the setting tool body 58, as illustrated in FIG. 3. This linear actuating movement of the pressure booster 70 substantially increases or boosts the pressure in pressure chamber 68, i.e. increases the pressure on a hydraulic actuation fluid 78 held in pressure chamber 68.

Figure 4:
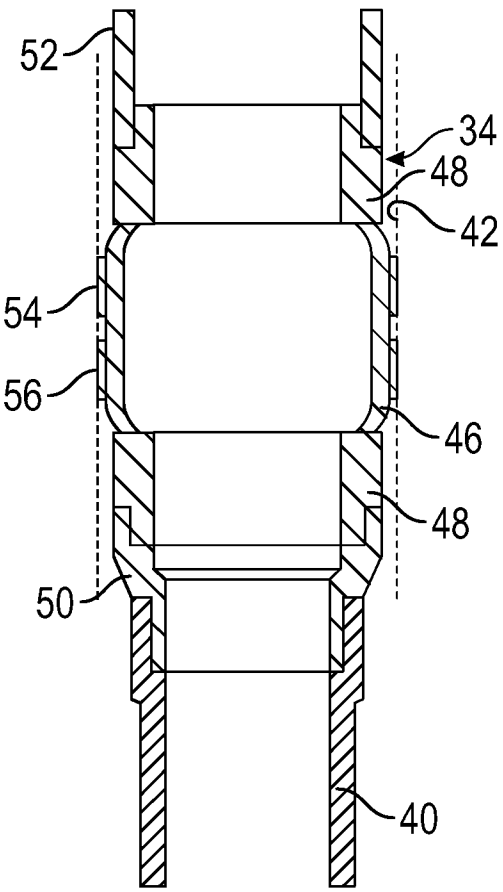
FIG. 4 is an illustration of the expandable liner hanger after removal of the setting tool, according to an embodiment of the disclosure.

The increased pressure forces the hydraulic actuation fluid 78 to discharge through the port or ports 62 into region 64 and to cause radial expansion of expandable metal hanger body 46. The boosted pressure is sufficient to cause plastic deformation of expandable metal hanger body 46 (see FIG. 3). The pressure booster 70 is shifted until the anchor structure 54 and sealing structure 56 are properly engaged with the surrounding surface 42, e.g. surrounding casing surface, as illustrated in FIG. 4. The setting tool 36 may then be released and withdrawn from the set liner hanger 34 (see FIG. 4). It should be noted the fixed ends 48 of expandable liner hanger 34 may undergo some elastic deformation during the setting process, but the fixed ends 48 then returned to their normal configuration upon release of the boosted pressure.

Figure 5:
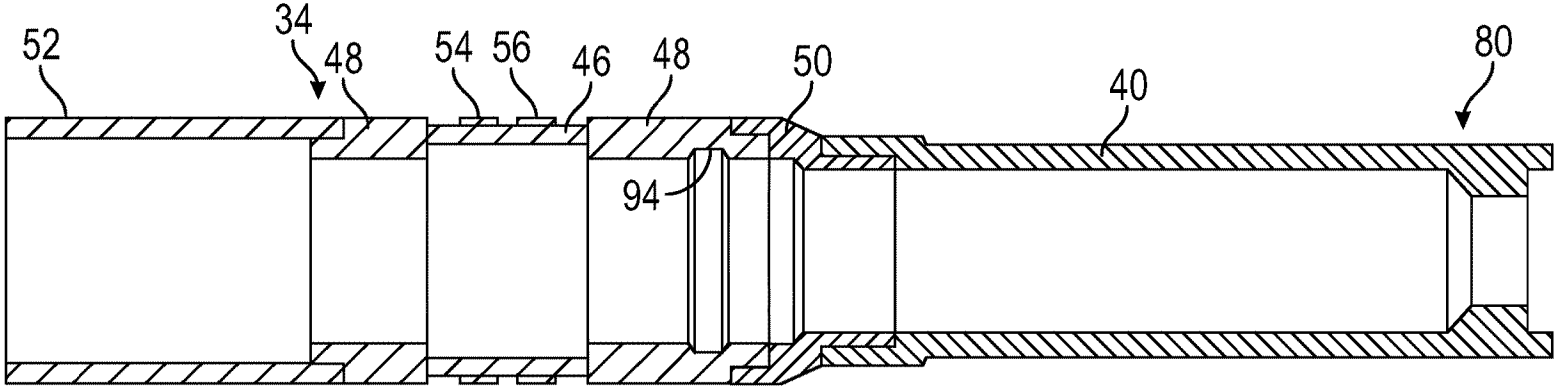
FIG. 5 is an illustration of an example of an expandable liner hanger coupled with a liner having a landing collar, according to an embodiment of the disclosure.
Figure 6:
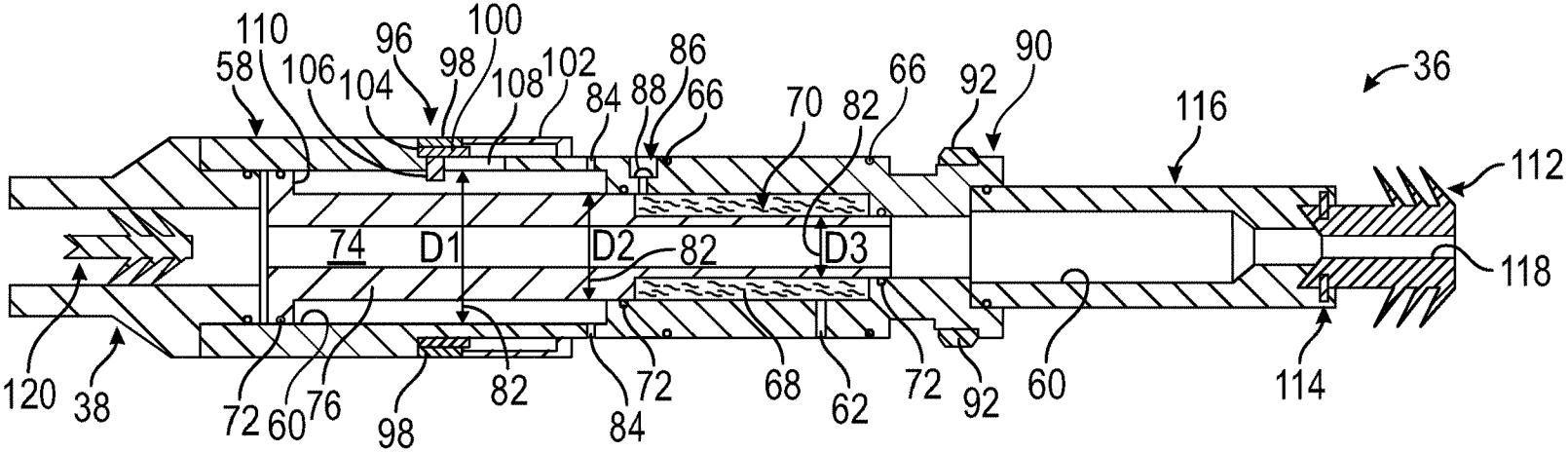
FIG. 6 is an illustration of an example of a setting tool for use with the expandable liner hanger, according to an embodiment of the disclosure.

Referring generally to FIGS. 5 and 6, additional, more detailed embodiments of the expandable liner hanger 34 and setting tool 36, respectively, are illustrated. As illustrated in FIG. 5, the expandable liner hanger 34 may be coupled with liner 40 via adapter sub 50 and the liner 40 may comprise or may be coupled with a landing collar 80.

As illustrated in FIG. 6, the setting tool 36 may again comprise a multi-diameter pressure booster 70 having a plurality of diameters 82, e.g. three successively smaller diameters labeled D1, D2 and D3. The pressure booster diameters 82 correspond with interior diameters of setting tool body 58 which allow the pressure booster 70 to form a slidable, sealed relationship with the interior 60 of setting tool body 58 via the differently sized seals 72, e.g. three seals 72 of differing diameters. In this example, the pressure chamber 68 is formed between seals 72 associated with diameters D2 and D3. It should be noted that fluid trapped between seals 72 associated with diameters D1 and D2 may be discharged through appropriate ports 84.

In this embodiment, a pressure release mechanism 86 also may be disposed in setting tool body 58. The pressure release mechanism 86 is constructed to release pressure from pressure chamber 68 to a region external to setting tool body 58, e.g. to annulus, upon pressure in pressure chamber 68 reaching a predetermined threshold. By way of example, the pressure release mechanism 86 may comprise a rupture disc 88.

In the illustrated example, the setting tool comprises a hanging device 90 which is used to releasably coupled the setting tool 36 with the expandable liner hanger 34. By way of example, the releasable hanging device 90 may comprise a plurality of dogs 92 which are releasably received in a corresponding profile 94 formed in expandable liner hanger 34. As explained in greater detail below, the releasable hanging device 90 may be selectively released via relative movement of pressure booster 70 with respect to setting tool body 58. In the embodiment illustrated, the dogs 92 work in cooperation with a setting tool release mechanism 96.

By way of example, the setting tool release mechanism 96 may comprise at least one lug 98 which may be held in a locked position by a sleeve 100. For example, the sleeve 100 may be used to maintain the lug(s) 98 in this locked position between an abutment member 102 and a shoulder 104 of setting tool body 58. A sleeve member 106 extends from the sleeve 100 and through a slot 108 formed radially through the setting tool body 58. The sleeve member 106 extends sufficiently far into interior 60 for engagement with a shoulder 110 of pressure booster 70.

In this example, the shoulder 110 is able to engage the sleeve member 106 and to shift the sleeve 100. The shifting of sleeve 100 releases the lug(s) 98 as the pressure booster 70 is moved to the end of its stroke relative to setting tool body 58. This action enables the release of locking dogs 92 as described in greater detail below.

With additional reference to FIG. 6, a wiper plug 112 may be releasably coupled with setting tool body 58 by, for example, a shear member 114, e.g. shear screws. In the specific example illustrated, the setting tool body 58 includes an extension 116 through which interior 60 continues to extend longitudinally. The wiper plug 112 is releasably coupled with this extension portion 116 and includes an internal wiper plug passage 118 so that fluid may flow through tubing 38, through an internal booster passage 74, through interior passage 60, and through plug passage 118.

Figure 7:
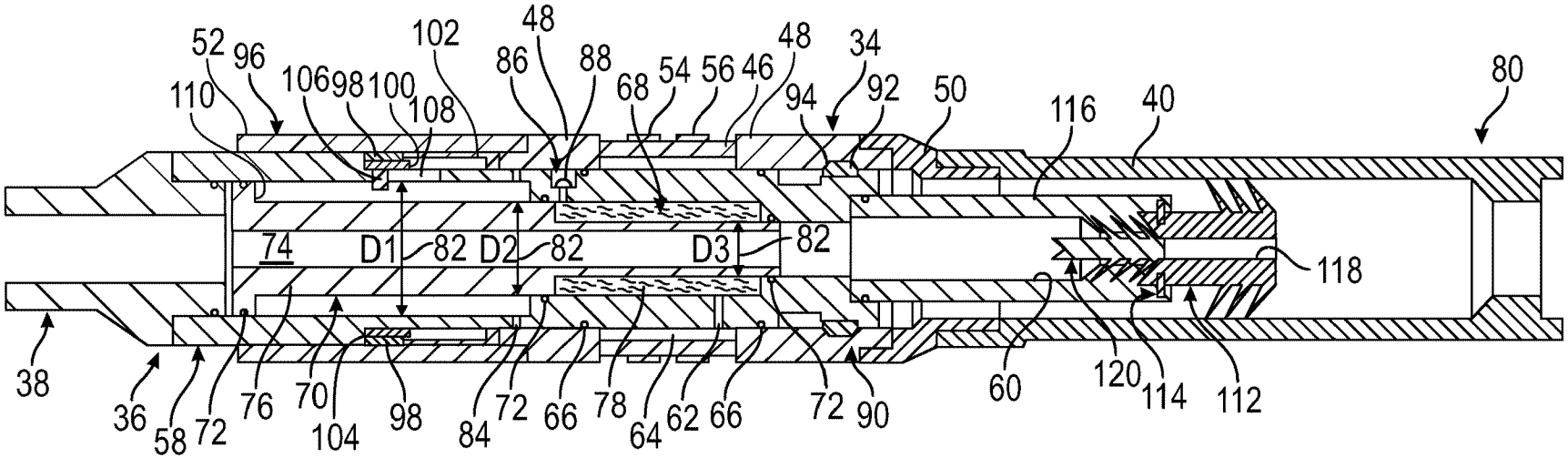
FIG. 7 is an illustration of an example of a setting tool coupled within an expandable liner hanger, according to an embodiment of the disclosure.
Figure 8:
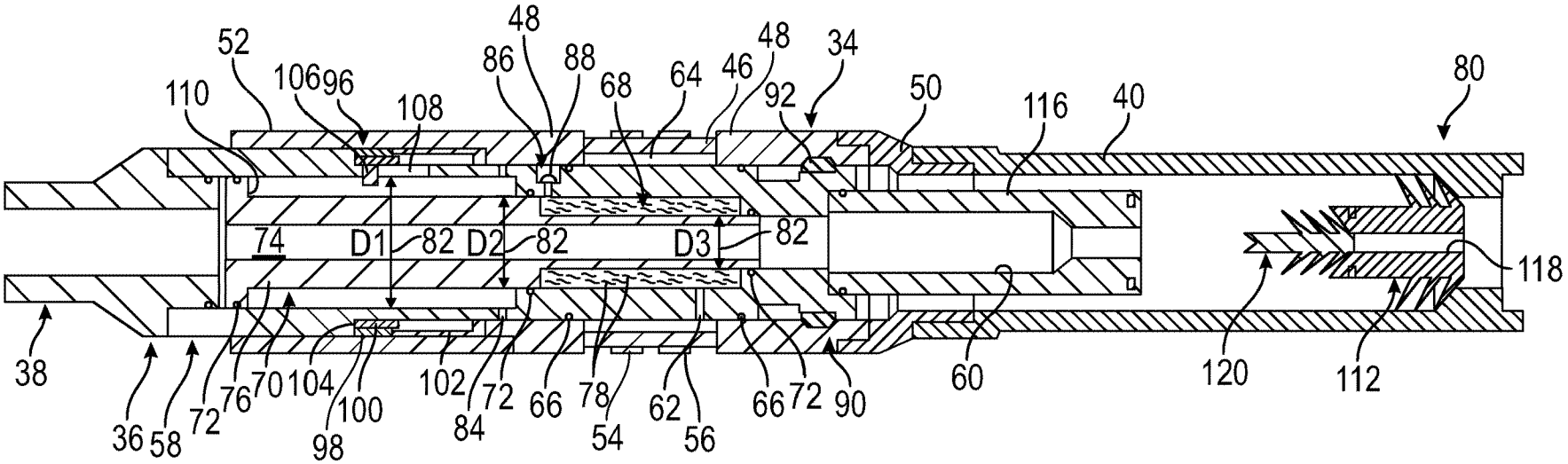
FIG. 8 is an illustration similar to that of FIG. 7 but in a different operational position, according to an embodiment of the disclosure.

However, flow through the interior of setting tool 36 may be blocked by delivering a pump down plug 120 down through tubing string 38 and through passages 74, 60 until the plug 120 lands in wiper plug 112 to block further flow therethrough. It should be noted the pump down plug may be in the form of a dart, ball, or other suitable plug type. In FIG. 7, the setting tool 36 is illustrated as releasably locked in engagement with expandable liner hanger 34 and pump down plug 120 has been landed in wiper plug 112. Once landed, pressure may be applied down through tubing 38 until shear member 114 is sheared and wiper plug 112 is released to move down through liner 40 until landed in landing collar 80, as illustrated in FIG. 8.

Figure 9:
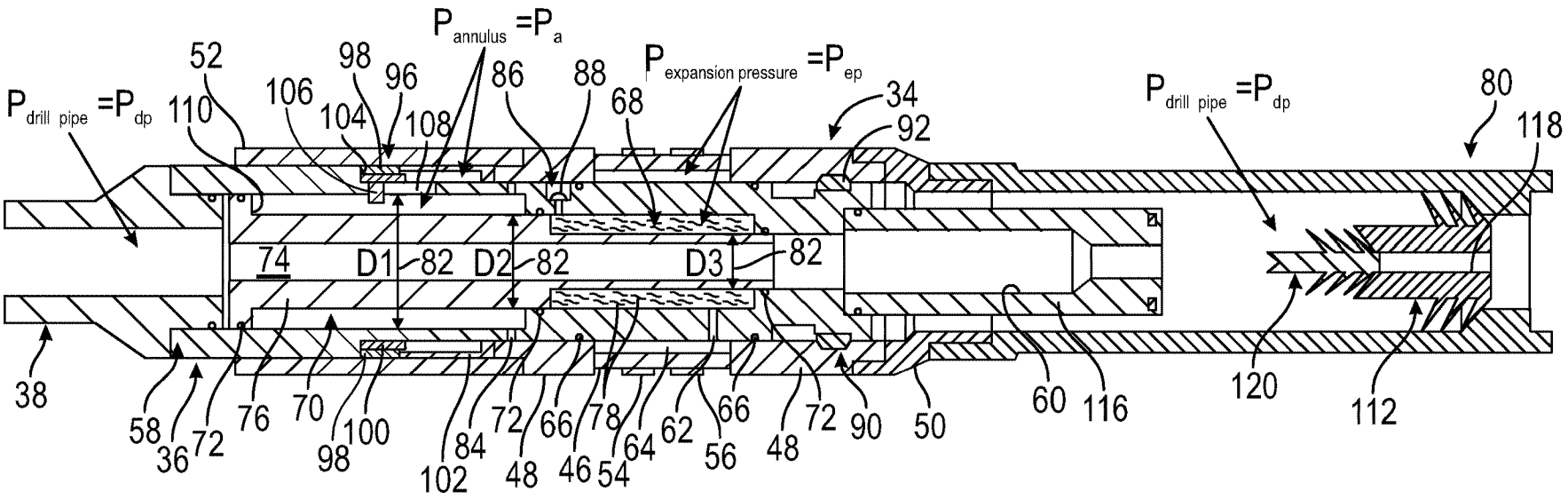
FIG. 9 is an illustration similar to that of FIG. 8 with the addition of pressure information, according to an embodiment of the disclosure.

At this stage, setting of the expandable liner hanger 34 may be initiated by applying pressure down through the drill pipe/tubing string 38 to create various pressures acting on pressure booster 70 as illustrated in FIG. 9. Because of the configuration of pressure booster 70, seals 72, and the multitiered interior surface of setting tool body 58, the pressure applied is boosted in pressure chamber 68, e.g. boosted 3-4 times or more relative to the pressure applied down through tubing 38. It should be noted the pressure chamber 68 may be located between the smallest diameter (D3) portion of the pressure booster 70 and a corresponding portion of the interior 60 of setting tool body 58 located between seals 72 associated with diameters D2 and D3. As an example, the actuation pressure applied down through tubing 38 is boosted in pressure chamber 68 according to the following mathematical description:

Surface areas:

$$S_1 = \pi/4 \times D_1^2$$

$$S_2 = \pi/4 \times (D_1^2 - D_2^2)$$

$$S_3 = \pi/4 \times (D_2^2 - D_3^2)$$

$$S_4 = \pi/4 \times D_3^2$$

Balance of the loads applied on the piston:

$$(P_{dp} \times S_1) = (P_a \times S_2) + (P_{ep} \times S_3) + (P_{dp} \times S_4) \qquad \text{Equation (1)}$$

Considering the differential pressures:

$$P_{dp} = P_{dp\ diff} + P_a$$

$$P_{ep} = P_{ep\ diff} + P_a$$

Equation (1) becomes: $(P_{dp\ diff}+P_a)\times(S_1-S_4)=P_a\times S_2+(P_{ep\ diff}+P_a)\times S_3$ Yet, $P_a\times(S_1-S_4)=P_a\times S_2+P_a\times S_3$ Hence, $P_{dp\ diff}\times(S_1-S_4)=P_{ep\ diff}\times S_3$ So, the ratio of the booster is equal to $$\frac{S_1 - S_4}{S_3} = \frac{D_1^2 - D_3^2}{D_2^2 - D_3^2}$$

Figure 10:
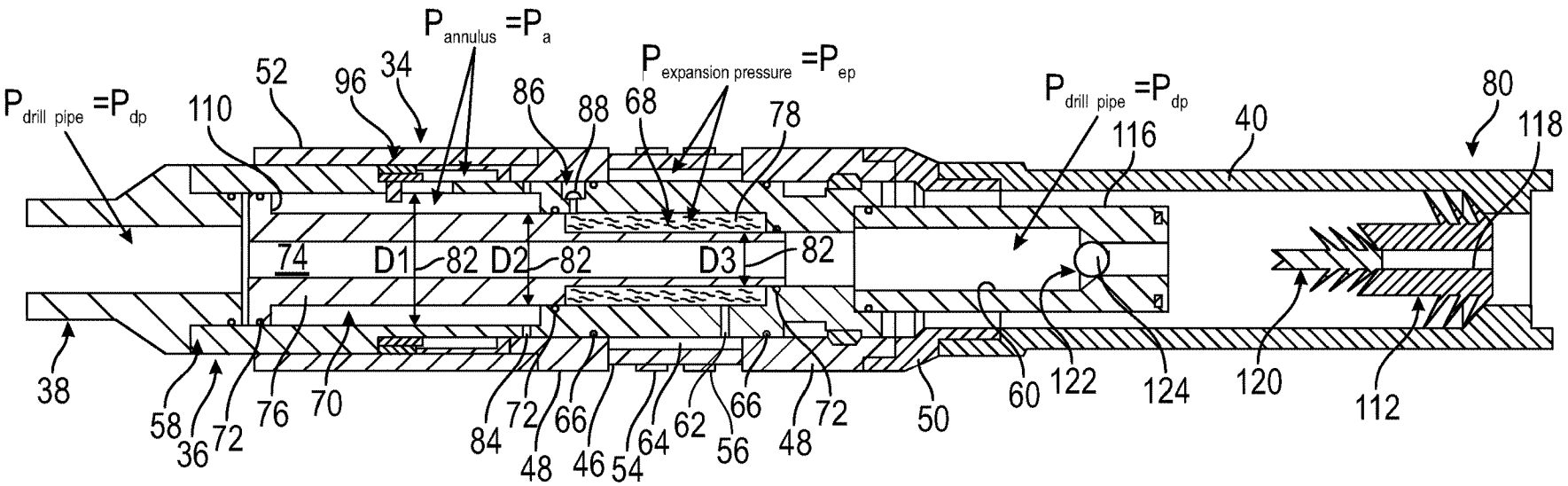
FIG. 10 is an illustration similar to that of FIG. 9 but showing a backup procedure for use in setting the expandable liner hanger, according to an embodiment of the disclosure.

It should be noted a backup system 122 may be utilized to ensure proper setting of expandable liner hanger 34 in the event of problems with, for example, seals, pressure booster 70, pump down plug 120, or other components. As illustrated in FIG. 10, the backup system 122 may comprise a landing profile located in extension portion 116 and sized to receive a ball 124 which blocks fluid flow through interior 60. The pump down plug 120 and the ball 124 function similarly in that they block flow along interior 60 on a downstream side of the interior 60 to obtain, for example, the same booster ratio.

Figure 11:
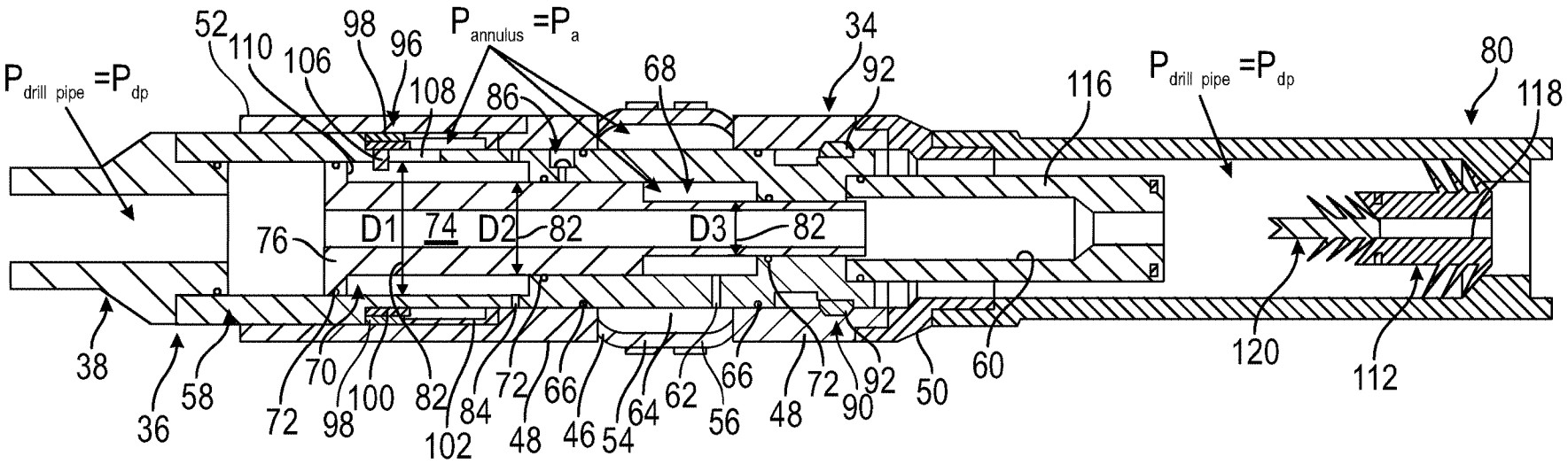
FIG. 11 is an illustration similar to that of FIG. 8 but in a different operational position, according to an embodiment of the disclosure.

While flow is blocked on the downstream side of interior 60, actuation pressure is applied down through tubing 38 on an upstream side of interior 60. This actuation pressure causes the pressure booster 70 to shift linearly relative to setting tool body 58 and to apply an increased/boosted pressure in pressure chamber 68. It should be noted the liner hanger 34 may be set by plugging the lower end of the liner 40 using, for example, wiper plug 112 and pump down plug 120 and then pressurizing the running string and the whole liner (see FIGS. 9 and 11). However, the liner hanger 34 also may be set by plugging the lower end of the setting tool 36 via, for example, ball 124 and then pressurizing the running string without pressurizing the whole liner (see FIG. 10). In either case, the increased pressure on the actuating fluid 78 within pressure chamber 68 causes the actuating fluid 78 to flow out through pressure port(s) 62 and into sealed region 64 so as to radially expand the expandable metal hanger body 46 of liner hanger 34 as illustrated in FIG. 11. As the pressure booster 70 continues to shift linearly with respect to setting tool body 58, the expandable metal hanger body 46 is plastically deformed into engagement with the surrounding wall surface 42.

Figure 12:
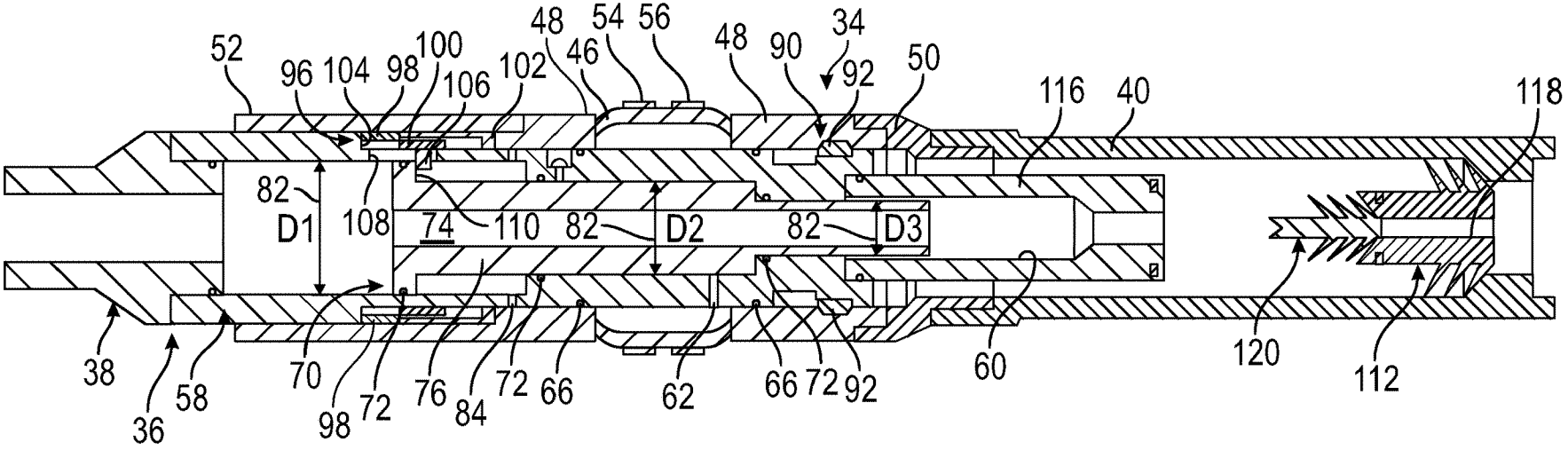
FIG. 12 is an illustration similar to that of FIG. 11 but in a different operational position, according to an embodiment of the disclosure.

When the liner expansion pressure reaches a predetermined value, the pressure release mechanism 86 releases, e.g. rupture disc 88 bursts, and the pressure in pressure chamber 68 drops and is balanced with annulus pressure. After release of pressure release mechanism 86, the pressure booster 70 is able to continue to move linearly, at low pressure, with respect to setting tool body 58 until shoulder 110 engages sleeve member 106, as illustrated in FIG. 12.

Figure 13:
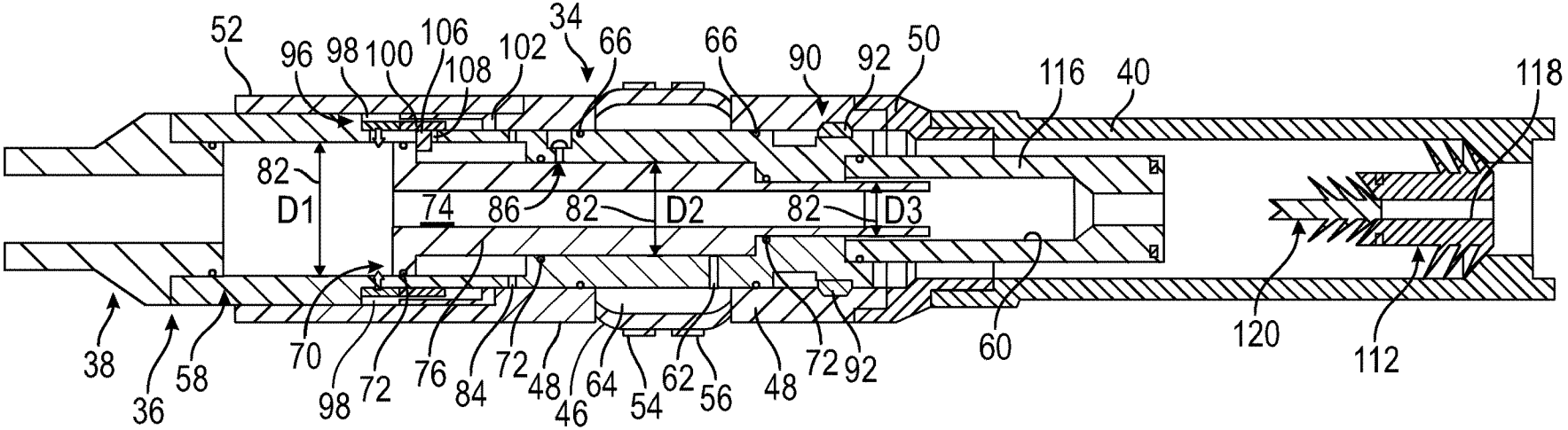
FIG. 13 is an illustration similar to that of FIG. 12 but in a different operational position, according to an embodiment of the disclosure.
Figure 14:
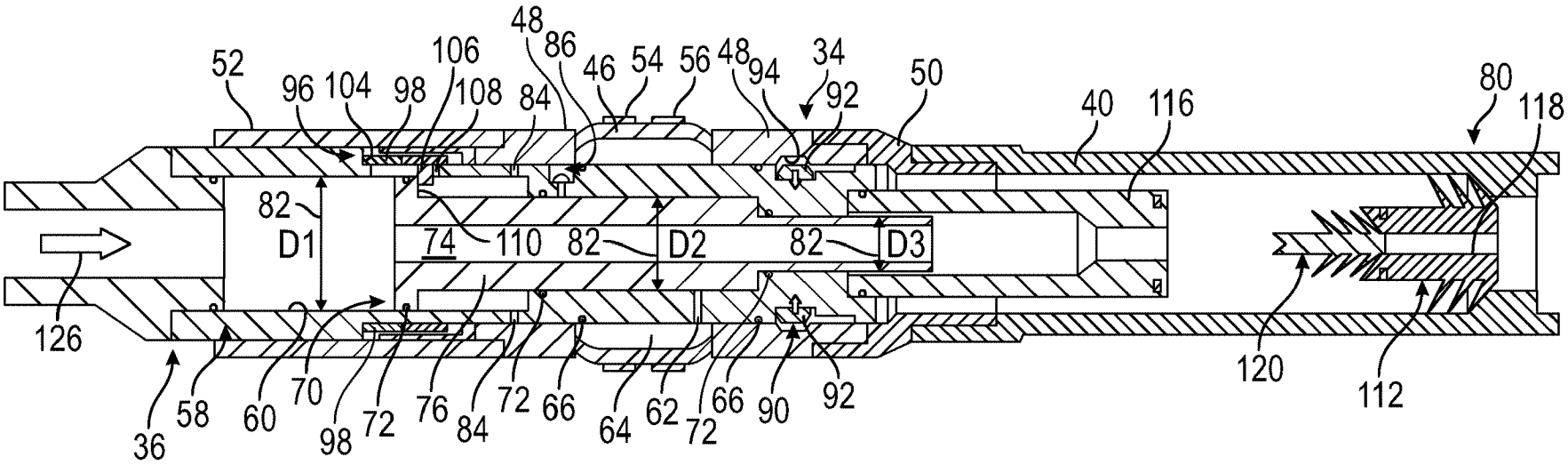
FIG. 14 is an illustration similar to that of FIG. 13 but in a different operational position, according to an embodiment of the disclosure.

The actuation pressure continues to move pressure booster 70 which, in turn, moves sleeve member 106 and corresponding sleeve 100 until lugs 98 are able to move radially inward, as illustrated in FIG. 13. In some embodiments, the lugs 98 may be spring biased toward the radially inward position. Once the lugs 98 move to the radially inward position, they are no longer trapped between abutment member 102 and setting tool body 58 so that both the pressure booster 70 and the setting tool body 58 may be shifted relative to liner hanger 34 in the direction of arrow 126, as illustrated in FIG. 14. It should be noted that the pressure in the drill pipe 38 prevents premature release during slacking off under pressure, thus preventing the setting tool 36 from being released prematurely and ejected by the pressure. The sequence to achieve a safe release is to release the pressure inside the drill pipe 38 and then to slack off the drill pipe 38 and the setting tool body 58.

Figure 15:
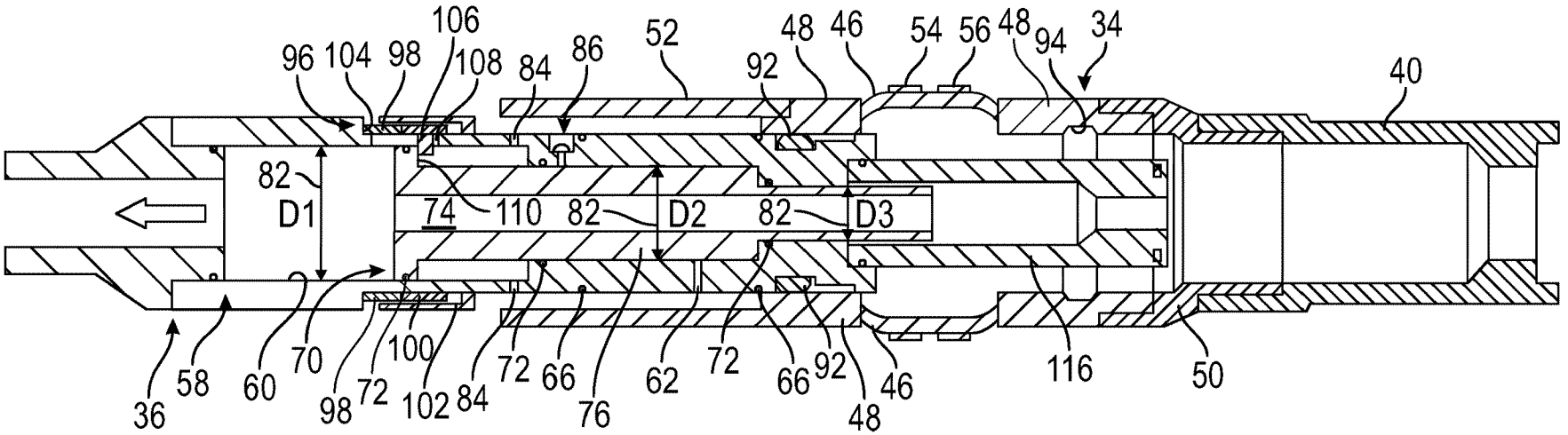
FIG. 15 is an illustration similar to that of FIG. 14 but in a different operational position, according to an embodiment of the disclosure.

The relative linear movement of setting tool body 58 with respect to liner hanger 34 allows dogs 92 of hanging device 90 to shift radially inward into a corresponding groove within the setting tool body 58, as further illustrated in FIG. 14. In some embodiments, the dogs 92 may be part of a collet spring which biases the dogs 92 radially inward and out of their corresponding profile 94 formed in expandable liner hanger 34. (A similar biasing system may be used for lugs 98.) The radially inward movement of dogs 92 effectively releases the setting tool 36 from the liner hanger 34 so that the setting tool 36 may be removed from the liner hanger 34, as illustrated in FIG. 15.

Referring generally to FIGS. 16-21, another embodiment of the setting tool 36 is illustrated as disposed in liner hanger 34. In this embodiment, many of the components are the same or similar to those of the embodiment described with reference to FIGS. 7-15 and have been labeled with common reference numerals. It should be noted this embodiment may utilize release mechanism 96 and hanging device 90/dogs 92 and pressure release mechanism 86. However, those components have been omitted from the illustrations to simplify explanation.

Figure 16:
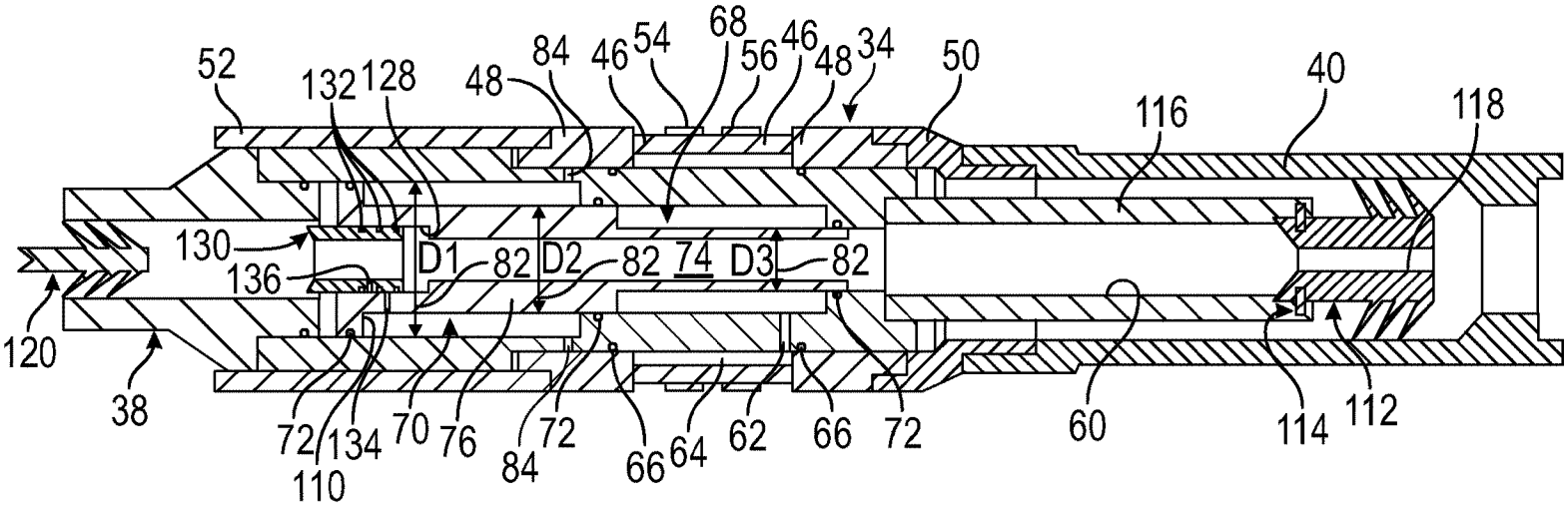
FIG. 16 is an illustration of another example of a setting tool coupled within an expandable liner hanger, according to an embodiment of the disclosure.

As illustrated in FIG. 16, this embodiment of setting tool 36 utilizes a pressure booster 70 having a recess 128 sized to receive a ball seat 130 in sealing engagement via a plurality of seals 132. By way of example, the ball seat 130 may be in the form of an inner sleeve sized to slidably and sealably engage the corresponding interior surface of recess 128.

In this embodiment, the pressure booster 70 comprises a lateral passageway 134 extending between the recess 128 and the region between pressure booster 70 and setting tool body 58 which is isolated by seals 72 at diameters D1 and D2. The ball seat 130 also comprises a lateral ball seat passageway 136, but the ball seat passageway 136 is initially misaligned with passageway 134 and isolated via corresponding seals 132. This sealed misalignment effectively provides the pressure booster 70 with an initial solid walled construction which does not allow lateral pressure release through the solid wall structure 76 of pressure booster 70.

Figure 17:
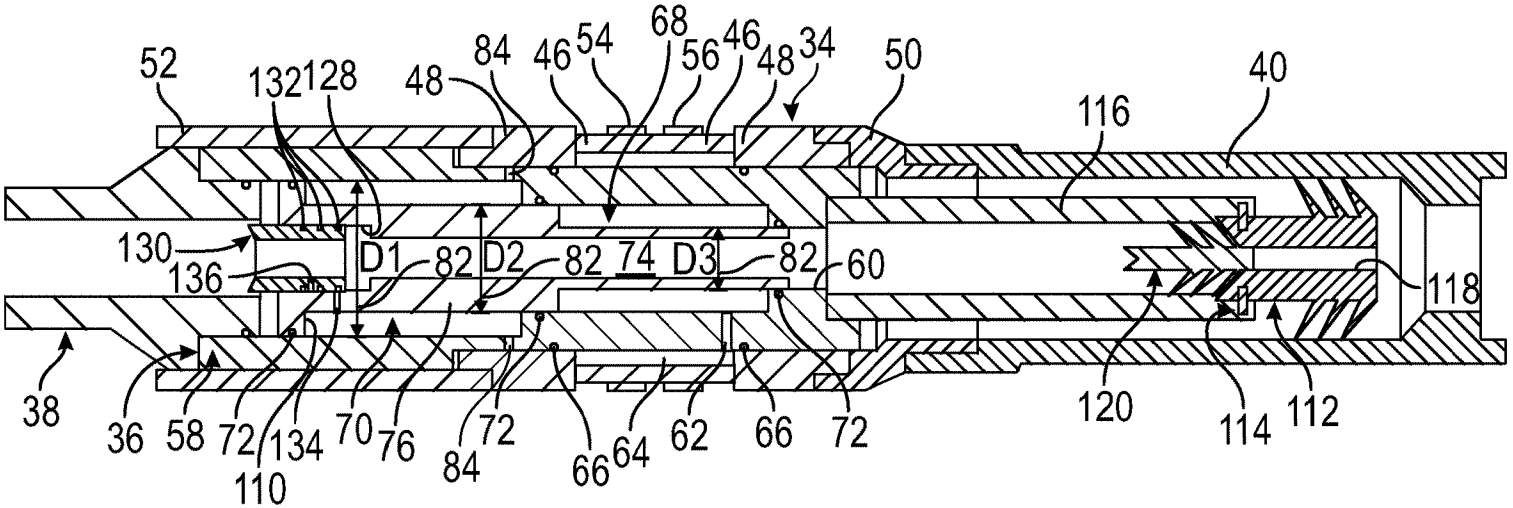
FIG. 17 is an illustration similar to that of FIG. 16 but in a different operational position, according to an embodiment of the disclosure.
Figure 18:
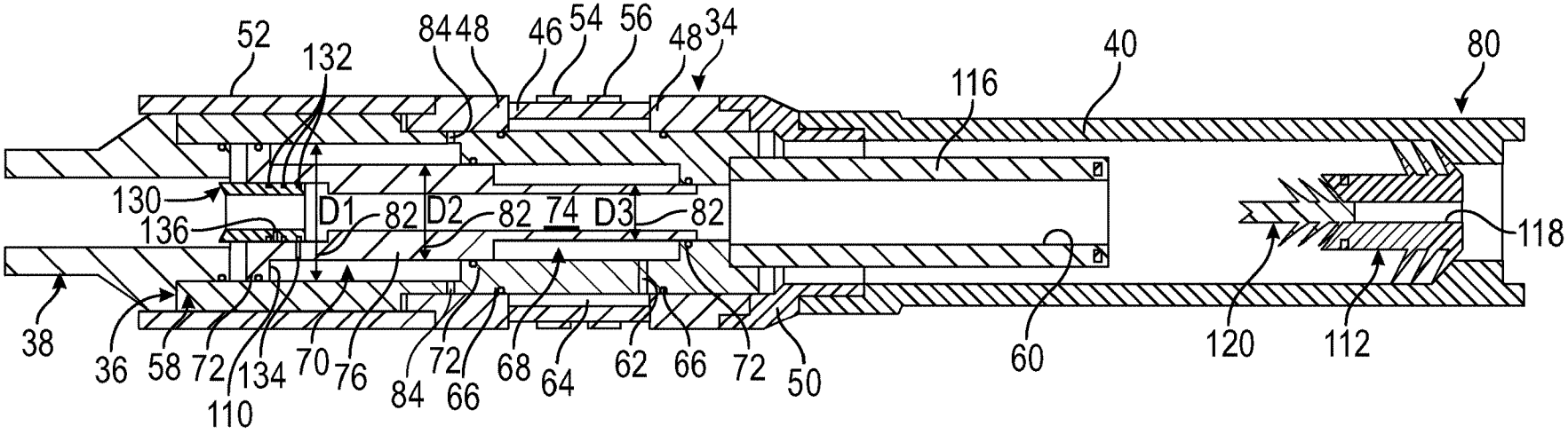
FIG. 18 is an illustration similar to that of FIG. 17 but in a different operational position, according to an embodiment of the disclosure.

In this embodiment, flow through the interior of setting tool 36 may similarly be blocked by delivering pump down plug 120 down through tubing 38 and through passages 74, 60 until the plug 120 lands in wiper plug 112 to block further flow therethrough. In FIG. 17, the setting tool 36 is illustrated as releasably locked in engagement with expandable liner hanger 34 and pump down plug 120 has been landed in wiper plug 112. Once landed, pressure may be applied down through tubing 38 until shear member 114 is sheared and wiper plug 112 is released to move down through liner 40 until landed in landing collar 80, as illustrated in FIG. 18.

Figure 19:
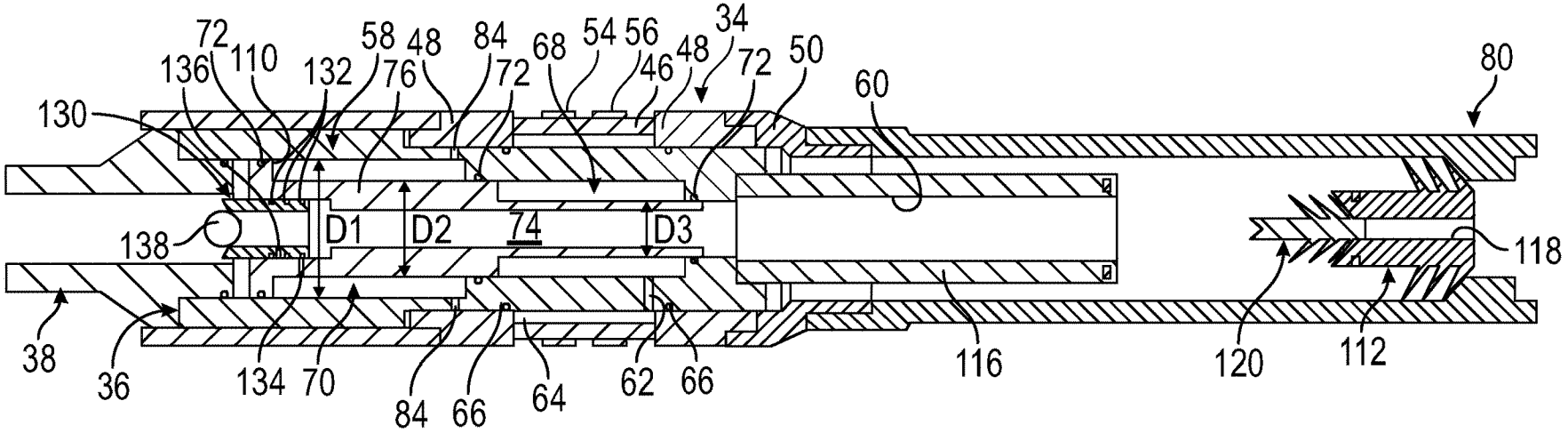
FIG. 19 is an illustration similar to that of FIG. 18 but in a different operational position, according to an embodiment of the disclosure.
Figure 20:
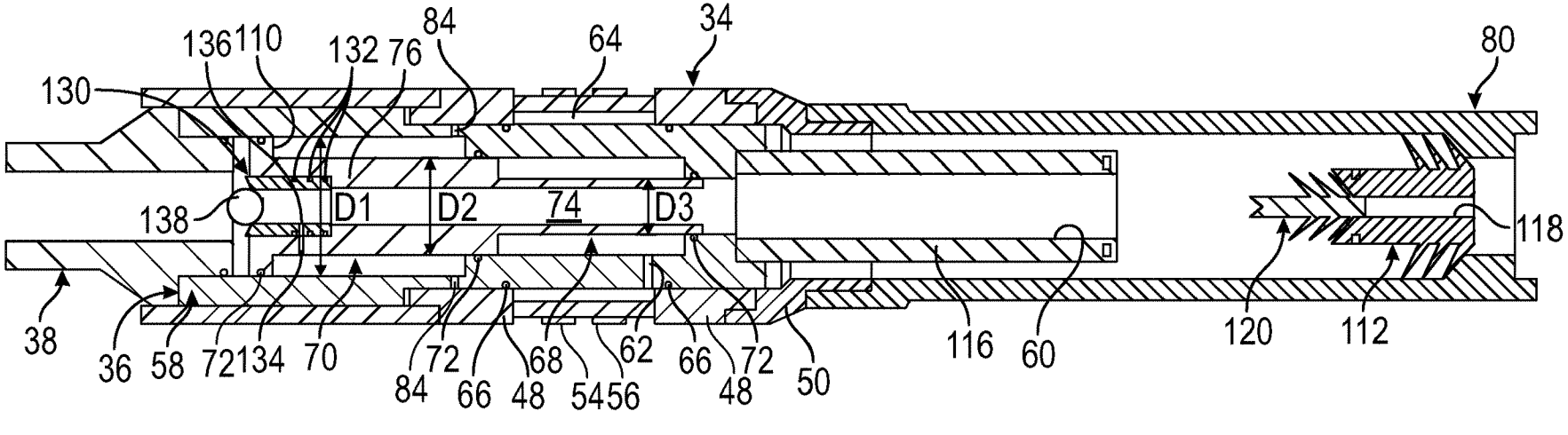
FIG. 20 is an illustration similar to that of FIG. 19 but in a different operational position, according to an embodiment of the disclosure.

At this stage, a ball 138 is dropped and landed on ball seat 130 to block flow along the internal booster passage 74 of pressure booster 70, as illustrated in FIG. 19. After landing ball 138 on ball seat 130 an increase in pressure applied through tubing 38 shifts the inner sleeve/ball seat 130 to a position of aligning lateral passageways 134 and 136. The alignment of passageways 134 and 136 balances the pressure between the annulus and the internal area (e.g. passageway 74 and interior 60) located between ball 138 and wiper plug 112, as illustrated in FIG. 20.

Figure 21:
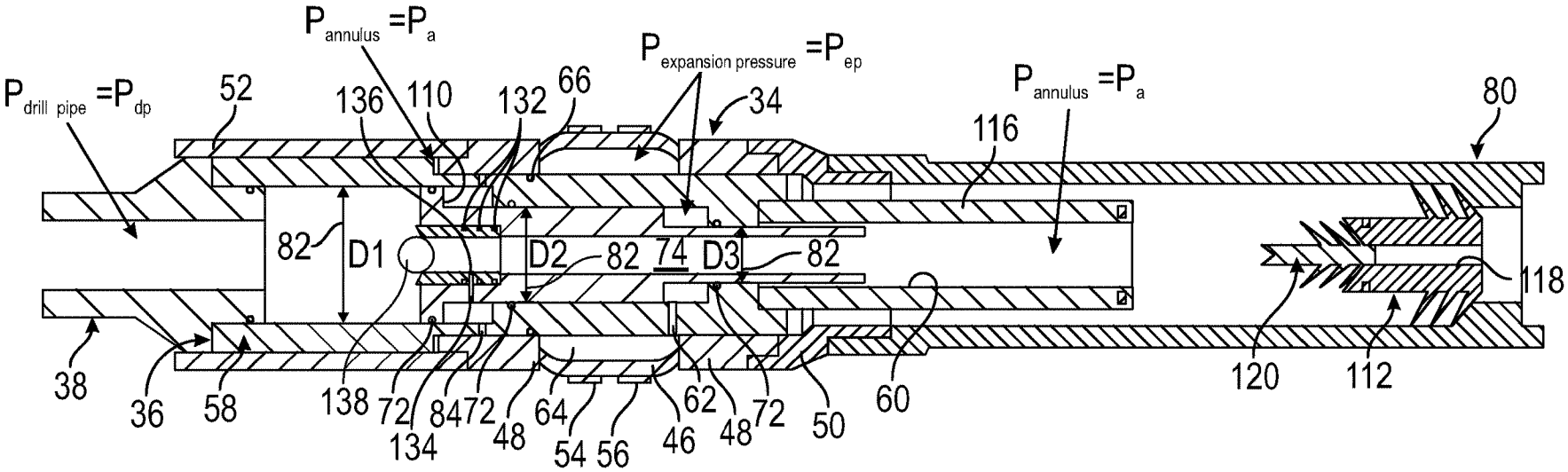
FIG. 21 is an illustration similar to that of FIG. 20 but in a different operational position, according to an embodiment of the disclosure.

The actuation pressure may then be applied down through tubing 38 so as to act on pressure booster 70 in a way which shifts the pressure booster 70 relative to the setting tool body 58. The shifting of pressure booster 70 relative to setting tool body 58 applies an increased/boosted pressure in pressure chamber 68. The increased pressure on the actuating fluid within pressure chamber 68 causes the actuating fluid 78 to flow out through pressure port(s) 62 and into sealed region 64 so as to radially expand the expandable metal hanger body 46 of liner hanger 34 as illustrated in FIG. 21. As the pressure booster 70 continues to shift linearly with respect to setting tool body 58, the expandable metal hanger body 46 is plastically deformed into engagement with the surrounding wall surface 42.

In this configuration, the actuation pressure applied may be boosted in pressure chamber 68 according to the following mathematical description:

Surface areas:

$$S_1 = \pi/4 \times D_1^2$$

$$S_2 = \pi/4 \times (D_1^2 - D_2^2)$$

$$S_3 = \pi/4 \times (D_2^2 - D_3^2)$$

$$S_4 = \pi/4 \times D_3^2$$

Balance of the loads applied on the piston:

$$(P_{dp} \times S_1) = (P_a \times S_2) + (P_{ep} \times S_3) + (P_a \times S_4) \qquad \text{Equation (2)}$$

Considering the differential pressures:

$$P_{dp} = P_{dp\ diff} + P_a$$

$$P_{ep} = P_{ep\ diff} + P_a$$

Equation (2) becomes: $(P_{dp\ diff}+P_a)\times S_1=P_a\times(S_2+S_4)+(P_{ep\ diff}+P_a)\times S_3$ Yet, $P_a\times S_1=P_a\times(S_2+S_4)+P_a\times S_3$ Hence, $P_{dp\ diff}\times S_1=P_{ep\ diff}\times S_3$ So, the ratio of the booster is equal to:

$$\frac{S_1}{S_3} = \frac{D_1^2}{D_2^2 - D_3^2}$$

Depending on the parameters of a given environment and well application, the expandable liner hanger 34 and the setting tool 36 may have various configurations. Similarly, the expandable liner hanger 34 and the setting tool 36 may be formed from various components and materials in suitable sizes and arrangements for the given well application. The seal/diameter ratios may be adjusted according to the desired levels of pressure boost to be applied in plastically deforming the expandable liner hanger. Additionally, various types of seals, setting tool release mechanisms, plugs, balls, pressure release mechanisms, and other types of features and or components may be used for a given well operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

an expandable liner hanger having an expandable metal hanger body between non-plastically deformable ends; and a setting tool releasably coupled with the expandable liner hanger via a hanging device, the setting tool comprising:

a setting tool body forming an interior with a plurality of interior diameters, the setting tool body further comprising a port extending from a pressure chamber located in the interior to an exterior region proximate the expandable metal hanger body;

wherein the setting tool further comprises a wiper plug having a longitudinal plug passage, the wiper plug being coupled to the setting tool body by a shear member; and a pressure booster slidably mounted along the interior, the pressure booster having a plurality of booster diameters join via seals with the plurality of interior diameters, the pressure booster having a longitudinal passage therethrough defined by a solid wall, the plurality of booster diameters being selected such that preventing release of pressure from the interior while applying pressure via an upstream end of the interior causes the pressure booster to shift and to drive fluid from the pressure chamber at a higher pressure level so as to cause expansion of the expandable metal hanger body.

2. The system as recited in claim 1, wherein the setting tool further comprises a release mechanism working in cooperation with the hanging device and actuated via movement of the pressure booster to release the setting tool from the expandable liner hanger.

3. The system as recited in claim 1, wherein pressure is released from the pressure chamber upon reaching a pressure level sufficient to trigger a pressure release mechanism.

4. The system as recited in claim 1, wherein the pressure booster has three different booster diameters.

5. The system as recited in claim 1, wherein the expandable liner hanger is coupled to a liner via an adapter sub.

6. The system as recited in claim 1, wherein the longitudinal plug passage is blocked via a pump down plug when pressure is applied to cause the pressure booster to shift.

7. The system as recited in claim 1, wherein the setting tool body comprises a ball seat on which a ball may be landed to retain pressure in the interior.

8. The system as recited in claim 1, wherein the hanging device comprises a plurality of releasable dogs.

9. The system as recited in claim 1, wherein the pressure chamber is established between a smallest diameter portion of the pressure booster and a corresponding portion of the interior of the setting tool body.

10. A system, comprising:

a setting tool for providing fluid under pressure to set a downhole device in a borehole, the setting tool comprising:

a setting tool body forming an interior, which extends longitudinally therethrough, and a pressure port in communication with the interior;

wherein the setting tool further comprises a wiper plug having a longitudinal plug passage, the wiper plug being coupled to the setting tool body by a shear member; and a pressure booster having a solid walled structure with a longitudinal passage extending through the solid walled structure, the pressure booster being slidably received in the interior and sealably coupled with the setting tool body by a plurality of seals having different diameters, the plurality of seals being arranged to create a pressure chamber positioned to discharge fluid under pressure through the pressure port as linear movement of the pressure booster occurs relative to the setting tool body, the linear movement being caused by application of pressure to the interior of the setting tool body.

11. The system as recited in claim 10, further comprising an expandable liner hanger having an expandable metal hanger body between non-plastically deformable ends.

12. The system as recited in claim 11, wherein the setting tool is releasably coupled to the expandable liner hanger via a hanging device.

13. The system as recited in claim 10, wherein the pressure booster comprises a recess slidably receiving a ball seat, the ball seat being shiftable via a ball to align lateral passages which create a lateral flow passage between an interior and an exterior of the pressure booster.

14. The system as recited in claim 10, wherein the plurality of seals comprises three seals of different diameters.

15. The system as recited in claim 10, wherein the longitudinal plug passage is selectively blocked via a pump down plug when pressure is applied to the interior of the setting tool body.

16. A method, comprising:

positioning a solid walled pressure booster within a setting tool body in a manner providing a setting tool with a longitudinal passage extending through the solid walled pressure booster and the setting tool body;

releasably coupling the setting tool with an expandable liner hanger having an expandable metal hanger body between non-plastically deformable ends;

wherein the setting tool further comprises a wiper plug having a longitudinal plug passage, the wiper plug being coupled to the setting tool body by a shear member;

conveying the expandable liner hanger and the setting tool downhole into a borehole via a tubing string;

expanding the expandable metal hanger body by applying pressure down through the tubing string until the pressure booster is shifted longitudinally within the setting tool body; and utilizing a pressure chamber and a plurality of different pressure booster diameters to intensify the pressure acting on the expandable metal hanger body relative to the pressure applied down through the tubing string to thus plastically deform the expandable metal hanger body.

17. The method as recited in claim 16, further comprising: suspending a liner with a landing collar from the expandable liner hanger; and blocking flow through the landing collar with the wiper plug and a pump down plug during setting of the expandable liner hanger.

18. The method as recited in claim 16, further comprising releasing the setting tool from the expandable liner hanger via continued movement of the pressure booster relative to the setting tool body.

* * * * *